US005729878A

United States Patent [19]

Kurihara et al.

[11] Patent Number: 5,729,878

[45] Date of Patent: Mar. 24, 1998

[54] WEB SPREADING APPARATUS

[75] Inventors: Kazuhiko Kurihara, Tokyo; Hiroshi Yazawa, Kunitachi; Yuki Kuroiwa, Shiki; Shuichi Murakami, Tokyo, all of Japan

[73] Assignees: Nippon Petrochemicals Company, Limited; Polymer Processing Research Instr., Ltd., both of Tokyo, Japan

[21] Appl. No.: 809,968

[22] PCT Filed: Aug. 7, 1996

[86] PCT No.: PCT/JP96/02230

§ 371 Date: Mar. 31, 1997

§ 102(e) Date: Mar. 31, 1997

[87] PCT Pub. No.: WO97/06086

PCT Pub. Date: Feb. 20, 1997

[30] Foreign Application Priority Data

Aug. 7, 1995 [JP] Japan ..... 7-231904

[51] Int. Cl.[6] ..... D06C 3/06

[52] U.S. Cl. ..... 26/101; 26/105

[58] Field of Search ..... 26/101, 102, 104, 26/105, 99; 492/44, 20

[56] References Cited

U.S. PATENT DOCUMENTS

| | | | |
|---|---|---|---|
| 829,805 | 8/1906 | Sackville | 26/101 |
| 1,347,714 | 7/1920 | Rowley | 26/105 |
| 2,626,422 | 1/1953 | Lammertse | 26/101 |
| 3,405,855 | 10/1968 | Daly et al. | 26/101 |
| 3,509,607 | 5/1970 | Fleissner | 26/101 |
| 3,828,998 | 8/1974 | Gross | 26/105 |
| 4,291,441 | 9/1981 | Bassani | 26/105 |

FOREIGN PATENT DOCUMENTS

| | | |
|---|---|---|
| 56-151246 | 11/1981 | Japan . |
| 58-47746 | 3/1983 | Japan . |
| 60-36956 | 3/1985 | Japan . |
| 61-90532 | 6/1986 | Japan . |
| 6-255851 | 9/1994 | Japan . |

*Primary Examiner*—Amy B. Vanatta

*Attorney, Agent, or Firm*—Burns, Doane, Swecker & Mathis, L.L.P.

[57] ABSTRACT

A web spreading apparatus for transversely spreading a web, such as a split web formed of a longitudinally uniaxially stretched film, includes a spreading means arranged in a travelling path of the web for transversely spreading the web. The spreading means comprises a curved rod-like member and projections arranged generally circumferentially about an axis of the curved rod-like member. The curved rod-like member is arranged so that the concave side is directed forward and the convex side is directed rearward, in the web travelling direction, and the projections are rotatable about the axis of the curved rod-like member at a speed higher than the travelling speed of the web. In one aspect, the curved rod-like member comprises a curved shaft and an outer tube arranged about the curved shaft and rotatable relative to the curved shaft, the projections being formed between the grooves cut on the outer tube. In another aspect, the projections are formed of a spring arranged about the curved rod-like member.

16 Claims, 11 Drawing Sheets

WEB SPREADING APPARATUS

TECHNICAL FIELD

The present invention relates to an apparatus for transversely spreading a web, such as a split web or a nonwoven fabric, so that the width of the web after spreading is equal to or greater than 1.2 times the width of the web before spreading.

BACKGROUND ART

A spread web obtained by transversely spreading a traveling web has been used in the field of a textile industry and a plastic film industry. For example, Japanese Examined Patent Publication (Kokoku) No. 53-38783 discloses the production of a cross-laminated nonwoven fabric (split fiber nonwoven fabric), by spreading a broad width uniaxially stretched split web or slit web. Also, U.S. Pat. No. 4,223,059 discloses the adjustment of the width and the transverse stretching of a nonwoven fabric. Japanese Examined Patent Publication (Kokoku) No. 4-36948 discloses the cross-lamination of webs stretched in the longitudinal direction. Also, a filament tow is often widened (this technique is referred to as a "tow-opening" in the textile industry) to be introduced into a Pacific converter or a tow cutter. Similarly, a tow-opening nonwoven fabric is well-known.

The web spreading of the present invention is used to increase the width of the web so that the width of the web after spreading is significantly larger than that of the web before spreading. A ratio of the width of the web after spreading to that of the web before spreading (resultant width to the original width) is referred to as the spreading ratio. The web spreading of the present invention means that the spreading ratio is 1.2 or more. Accordingly, the web spreading of the present invention is different from the correction or prevention of wrinkles and creases. In the correction or prevention of wrinkles and creases, the width of the web does not substantially change. Also, the web spreading of the present invention is different from transverse web stretching. While the object of transverse web stretching is to cause molecules to orientate in the transverse direction by the stretching, the web spreading only spreads the width of the web without any change in the molecular orientation. Although, in the case of spreading a nonwoven fabric, some of the filaments may be stretched and oriented, such orientation is very small on the whole.

In the prior art, a curved expander roll is used to prevent occurrence of wrinkles and creases in a traveling web, such as a paper, a film or a fabric. There may be a case wherein the width of the web is slightly enlarged during the use of the curved expander rolls. However, the spreading ratio is low in such a case and substantial web spreading is not effected. The spreading ratio becomes larger if a curvature of the expander roll increases or a tension of the traveling web increases, but a desired larger spreading ratio is not yet obtainable and the resultant web has the inferior uniformity.

Alternatively, it may be possible to increase the width of the web by using a screw roll. In such a case, the spreading ratio becomes larger than that when the expander roll is used, but the uniformity of the resultant web is deteriorated, such that the central zone of the web is widened to a greater extent, while the side edge zone has a lower spreading ratio. Thus, the screw roll is not used for spreading the web at a high spreading ratio.

To solve the above drawbacks, various spreading apparatuses have been proposed and disclosed in, for example, Japanese Examined Patent Publications (Kokoku) No. 46-43275, No. 50-40186, No. 51-30182 and No. 58-10507. The spreading apparatus disclosed in the above Kokoku No. 46-43275 uses a plurality of coil springs arranged in the web traveling direction at a certain pitch, each coil spring extending in the transverse direction. These coil springs are gradually transversely expanded while moving in the web traveling direction. The web is carried by the coil springs and transversely spread. This spreading apparatus has been used by the present applicant because the web can be uniformly spread at a higher spreading ratio. However, this spreading apparatus is relatively complicated in structure and thus expensive because a plurality of moving coil springs are used. A problem occurs in this spreading apparatus that a higher speed operation is difficult and it is difficult to treat a broader web.

The spreading apparatuses disclosed in the above Kokai No. 50-40186, No. 51-30182 and No. 58-10507 are simple in structure and adapted for high speed operation and the treatment of broader webs, but there is a problem that the some kind of webs are not uniformly spread.

Further, in the prior art spreading apparatuses, it is not possible to control the width of the web and the uniformity of the resultant web depends on the kind of the web and on working conditions such as line speed or others, in the in-line condition.

SUMMARY OF THE INVENTION

An object of the present invention is to solve the above described problems and to provide a web spreading apparatus which is simple in structure and capable of achieving a high spreading ratio by which a web can be uniformly spread.

Another object of the present invention is to provide a web spreading apparatus which can be controlled immediately following changes such as changes in the kind of webs and unevenness of the web, or changes in a working condition of the apparatus such as a line speed or others, or changes required for production such as a spreading ratio or the like, so that a product having a stable quality is always obtainable.

According to the present invention, there is provided a web spreading apparatus for transversely spreading a web so that the width of the web after spreading is equal to, or greater than, 1.2 times the width of a web before spreading, said apparatus comprising conveying means for conveying the web along a predetermined conveying path; tension control means for controlling tension in the travelling web; spreading means arranged in the conveying path for transversely spreading the web; said spreading means comprising a curved rod-like member having a concave side, a convex side and an outer circumference surface, and projections arranged generally circumferentially about an axis of the curved rod-like member; said curved rod-like member being arranged so that the concave side is directed forward and the convex side is directed rearward, in view of the web travelling direction; at least said projections being rotatable about the axis of the curved rod-like member at a speed higher than a travelling speed of the web; and said spreading means being arranged such that a spreading distance from a spreading-starting point to said spreading means is equal to, or more than, two times the width of the web after spreading.

This web spreading apparatus is simple in structure, and suitable for treating various types of webs at a higher spreading ratio, and provides excellent uniformity in the spreading property.

BRIEF DESCRIPTION OF THE DRAWINGS

The present invention will be described in more detail regarding the preferred embodiments thereof with reference to the attached drawings; in which.

BEST MODE FOR CARRYING OUT THE INVENTION

Figure 1:
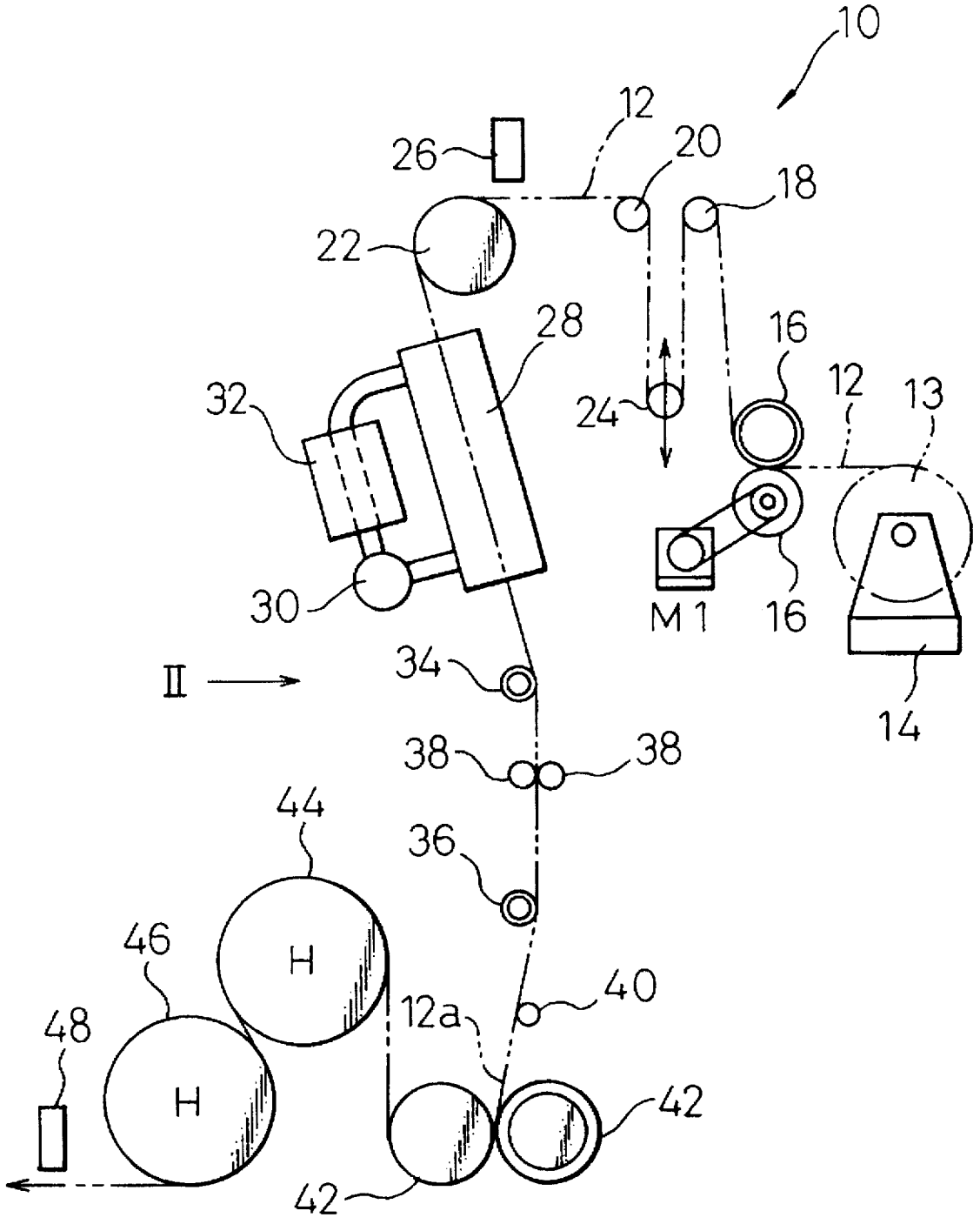
FIG. 1 is a side elevational view of a web spreading apparatus according to one embodiment of the present invention.
Figure 2:
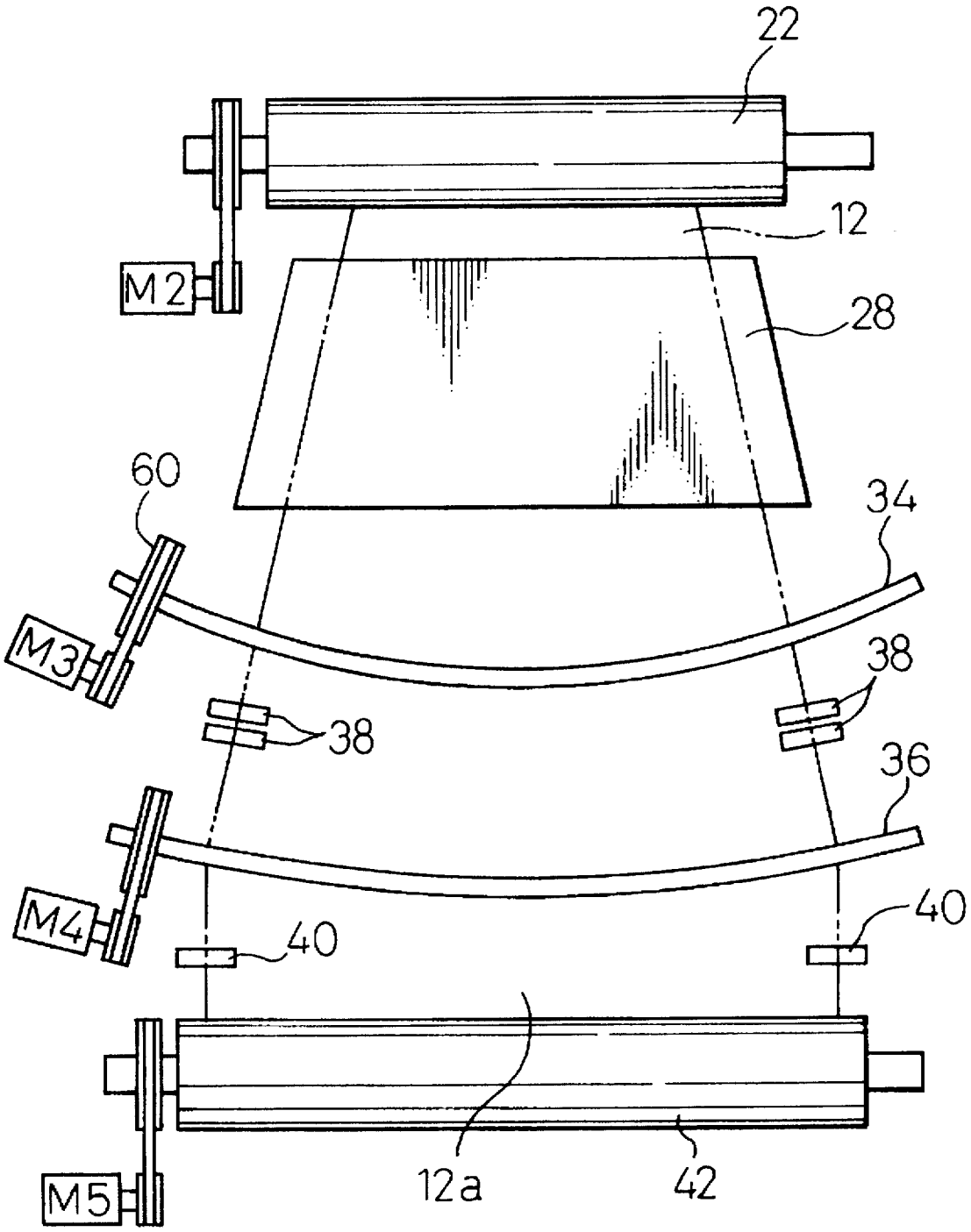
FIG. 2 is a front view of the spreading apparatus, seen in the direction of the arrow II in FIG. 1.

FIGS. 1 and 2 show a web spreading apparatus 10 according to one embodiment of the present invention. The spreading apparatus 10 has a not shown frame.

The spreading apparatus 10 includes a reel 14 for supporting a roll 13 of a web 12, a pair of delivery rollers 16, guide rollers 18 and 20, and a speed regulating roller 22. One of the delivery rollers 16 is driven by a motor M1, and the other delivery roller 16 is a nip roller. The web 12 is pulled by the delivery rollers 16 to be unwound from the roll 13, and guided to the speed regulating roller 22 via the guide rollers 18, 20. The speed regulating roller 22 is driven by a motor M2.

A torque sensing roller 24 is arranged between the guide rollers 18 and 20 and the motor M1 (and thus the delivery roller 16) is automatically controlled based on an output from the torque sensing roller 24 so that tension P of the traveling web 12 is kept constant. Other tension regulating means such as a dancer roller may be used in place of the torque sensing roller 24. A width sensor 26 is arranged above the speed regulating roller 22 and the motor M2 is controlled based on an output from the width sensor 26 so that a width of the web 12 is maintained constant on the speed regulating roller 22. Also, it is possible to replace the speed regulating roller 22 with a stationary bar and to arrange a cloth guider in front of, or behind, the stationary bar to achieve the above purpose. The traveling path for the web is constituted by the delivery rollers 16, the guide rollers 18 and 20, the speed regulating roller 22 and other rollers described hereinafter. The speed regulating roller 22 is arranged at a higher position in the spreading apparatus 10, and the web traveling path goes downward from the speed regulating roller 22.

The spreading apparatus includes a hot air chamber 28 below the speed regulating roller 22, and a fan 30 and a heater 32 are attached to the hot air chamber 28. Hot air is supplied to the hot air chamber 28 by the fan 30 and the heater 32 to release a strain or irregularity in the web 12 passing through the hot air chamber 28 and thus homogenize the property of the web 12. The hot air chamber 28 may be used depending on kinds of webs 12 to be used, and in some cases, may not be necessary. In particular, when the web 12 is stocked wound in the roll 13, unevenly wound portions may occur in the web 12 which may disturb a uniform spreading operation, and in such a case, it is possible to solve the unevenly wound portions by passing the web through the hot air chamber 28. Also, by the use of the hot air chamber 28, it is possible to equalize a transverse tension of the web 12. Instead of the hot air chamber 28, other heat treatment means may be used, such as a hot cylinder or a batch type oven capable of heat-treating the web in a roll form.

The spreading apparatus 10 includes spreading rollers 34 and 36 arranged in series below the hot air chamber 28. The spreading rollers 34 and 36 are described in detail later. While two spreading rollers 34 and 36 are used in this embodiment, the number thereof may be selected in accordance with kinds of webs 12 to be used. For example, one or three spreading rollers may be used. Also, auxiliary spreading means may be used in association with the spreading rollers 34 and 36. For example, a cloth guider 38 is arranged between the spreading rollers 34 and 36, and a side edge spreading roller 40 is arranged next to the spreading roller 36 in this embodiment. Takeup rollers 42 are arranged on the downstream side of the side edge spreading roller 40, and heat-treatment rollers 44 and 46 follow thereto. One of the takeup rollers 42 is driven by a motor M5, while the other takeup roller 42 is used as a nip roller. The heat treatment rollers 44 and 46 are not illustrated in FIG. 2. The web 12*a* which is spread by the spreading rollers 34 and 36 is fed to the subsequent process via the takeup rollers 42 and the heat treatment rollers 44 and 46, or taken up by a winder not shown. A spreading state sensor 48 is arranged at a suitable position on the downstream side of the spreading roller 36. In this embodiment, the spreading state sensor 48 is located next to the heat treatment roller 46. The spreading state sensor 48 has a function for detecting a width R and a density S of the spread web 12*a*. In this regard, a width sensor and a density sensor may be separately provided for detecting the width R and the density S of the widened web 12*a*, respectively. The density S may be obtained by measuring the number of fibers within a portion of the web 12 or a thickness of the web 12*a*. The spreading rollers 34 and 36 are driven by motors M3 and M4, respectively, and the motors M3 and M4 are controlled based on an output from the spreading state sensor 48.

Figure 3:
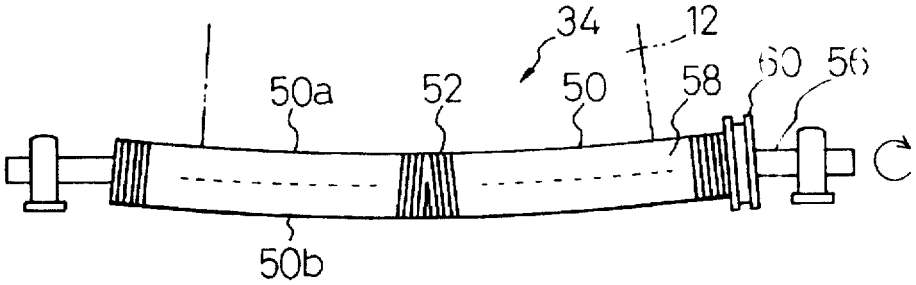
FIG. 3 is a plan view of a spreading roller comprising a curved rod-like member in FIGS. 1 and 2.
Figure 4:
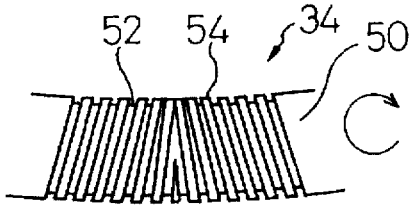
FIG. 4 is a partially enlarged view of the spreading roller of FIG. 3.

FIGS. 3 and 4 illustrate the spreading roller 34 in detail. The other spreading roller 36 also has the same structure. The spreading roller 34 comprises a curved rod-like member 50 having continuously and circumferentially extending grooves 52 and projections 54 about the curved rod-like member 50. The projections 54 are formed between two adjacent grooves 52. The curved rod-like member 50 is a single rod or roller which is curved in one plane so that the central portion thereof is convex, and the curved rod-like member 50 has a concave side 50*a* and a convex side 50*b*. As shown in FIGS. 2 and 3, the spreading roller 34 (curved rod-like member 50) is arranged such that the concave side 50*a* is located forward and the convex side 50*b* is located rearward, in the traveling direction of the web 12.

The curved rod-like member 50 shown in FIGS. 3 and 4 is manufactured, for example, from a commercially available expander roll. The expander roll consists of a curved shaft 56 and an outer tube 58 made of rubber or plastic which covers the curved shaft 56 and rotates via ball bearings or the like. The grooves 52 are formed on the outer circumference surface of the outer tube 58 so that the projections 54 are formed between two adjacent grooves 52. The grooves 52 and the projections 54 spirally extend in a symmetrical manner with respect to a center of the outer tube 56. The grooves 52 and the projections 54 may be of a single thread shape or a multi-thread shape.

A pulley 60 is attached to the outer tube 58 and the pulley 60 is connected to the motor M3, as shown in FIG. 2. Therefore, the outer tube 58 having the grooves 58 cut thereon is driven for rotation relative to the stationary curved rod-like member 50.

Figure 5:
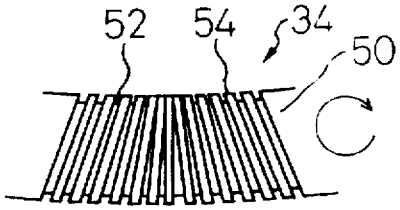
FIG. 5 is a view of a modification of the spreading roller.

FIG. 5 illustrates a modification of the spreading roller 34. According to this modification, the spreading roller 34 is prepared from an expander roll, similar to the previous example, and annular grooves 52 and annular projections 54 are formed on the outer tube 58 generally at a constant pitch.

Figure 6:
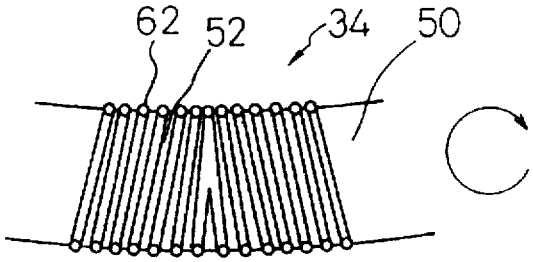
FIG. 6 is a view of another modification of the spreading roller.

FIG. 6 illustrates another modification of the spreading roller 34. The spreading roller 34 is prepared from an expander roll, similar to the examples of FIGS. 4 and 5, and spiral or annular grooves 52 and spiral or annular projections 54 are formed on the outer tube 58. In addition, a cord 62 is wound on the spreading roller 34 in the grooves 62 and bonded thereto. Therefore, wear-resistance of the spreading roller 34 is improved. As the cord used therefor, a resinous cord made, for example, of urethane resin, polyamide resin, silicon resin and fluorine type resin, or a steel wire is suitable. Such a cord can be easily replaced with a fresh one if worn, or it is possible to adjust coefficient of friction of the surface by changing the kind of cords.

In the above described examples, the curved rod-like member 50 of the spreading roller 34 is made from an expander roll. However, it is possible to make the curved rod-like member 50 from other members than the expander roll. For example, the curved rod-like member 50 may be manufactured by a plurality of short steel pipes coupled together in the form of a curved rod-like member and by forming grooves or projections on the circumference thereof.

Figure 7:
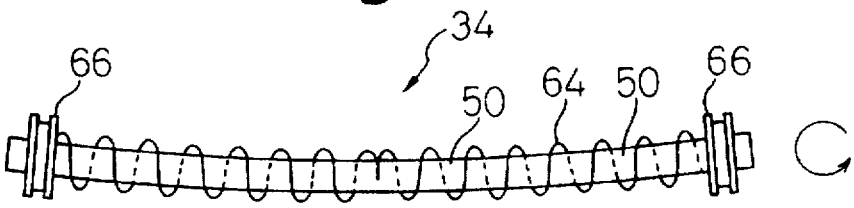
FIG. 7 is a view of a further modification of the spreading roller.

FIG. 7 illustrates a further modification of the spreading roller 34. This spreading roller 34 includes a curved rod-like member 50 consisting of a flexible shaft. A coil spring 64 is arranged about the curved rod-like member 50 and the opposite ends thereof are secured to pulleys 66. The pulleys 66 are rotatably supported by the rod-like member 50. In this example, the curved rod-like member 50 is stationary, and the coil spring 64 is driven for rotation about the curved rod-like member 50 via the pulleys 66. In this case, the coil spring 64 has a similar function to the grooves 52 and projections 54 of the preceding examples.

Figure 8:
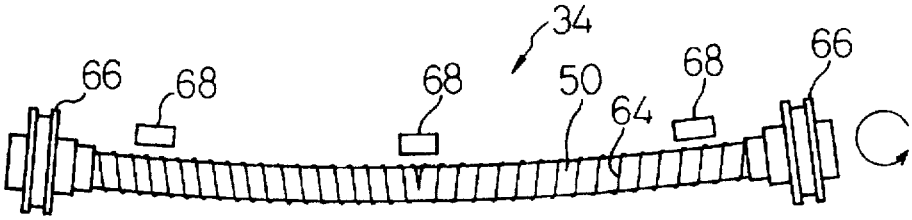
FIG. 8 is a view of a further more modification of the spreading roller.

FIG. 8 illustrates a further modification to the spreading roller 34. This spreading roller 34 includes a curved rod-like member 50 consisting of a flexible shaft. A coil spring 64 is arranged about the curved rod-like member 50 and secured at the opposite ends thereof to the curved rod-like member 50. Pulleys 66 are attached to the curved rod-like member 50. In this example, the curved rod-like member 50 with the coil spring 64 is driven for rotation. If the shape of the rod-like member 50 is unstable, guide rollers 68 may be arranged along the curved rod-like member 50. By the way, the spiral direction of the grooves 52 shown in FIGS. 3 and 4 is reverse to that of the coil spring 64 shown in FIGS. 7 and 8. It is contemplated that the web 12 travels on the far side of the spreading roller 34 in FIGS. 3 and 4, and on the near side in FIGS. 7 and 8.

Figure 9:
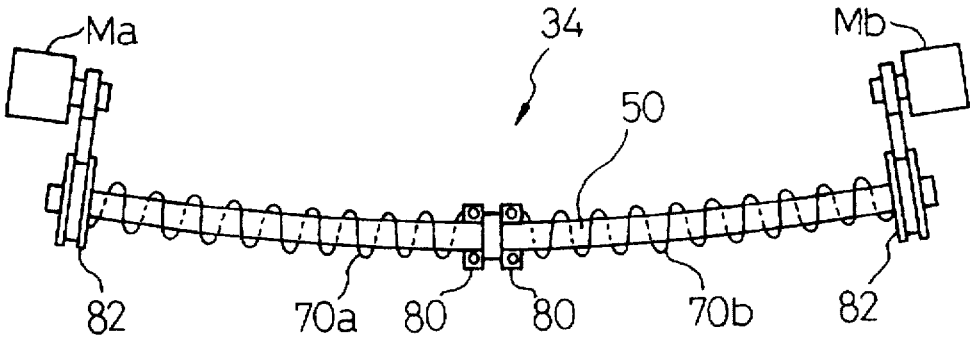
FIG. 9 is a view of a still further modification of the spreading roller.

FIG. 9 illustrates a still further modification of the spreading roller 34. This spreading roller 34 includes a curved rod-like member 50, and a pair of coil springs 70*a* and 70*b* are arranged about the curved rod-like member 50 symmetrically with respect to a center of the curved rod-like member 50. The inner ends of the respective coil spring 70*a* and 70*b* are secured to bearings 80 which are rotatably mounted to the curved rod-like member 50, while the outer ends of the respective coil spring 70*a* and 70*b* are secured to pulleys 82 which are rotatably held on the curved rod-like member 50. The pulleys 82 are driven by motors Ma and Mb, respectively. Therefore, the coil spring 70*a* and 70*b* are separately driven from each other, and if a spreadability of the web 12 in the right or left portions thereof differs from the other, it is possible to uniformly spread the web 12 by changing the speeds of the motors Ma and Mb. On the other hand, in FIG. 8, the opposite ends of the coil spring 64 are secured to the pulleys 66, and this is suitable when the spreading roller 34 is longer, both pulleys 66 being driven for rotation preferably at the same speed.

FIGS. 10A to 10E illustrate examples of an auxiliary spreading roller 84 which can be used with the spreading rollers 34 and 36. The auxiliary spreading roller 84 shown in FIG. 10A comprises an expander roller which is particularly effective for expanding the end portions of the web 12. The auxiliary spreading roller 84 shown in FIG. 10B comprises an expander roller which is particularly effective for expanding a central portion of the web 12. The auxiliary spreading roller 84 shown in FIG. 10C comprises a roller which has a smaller diameter in a central portion thereof and a larger diameter in the end portions thereof so that the peripheral speed becomes larger in the end portions. These features may be incorporated also into the spreading rollers 34 and 36 of the present invention.

Figure 10A:
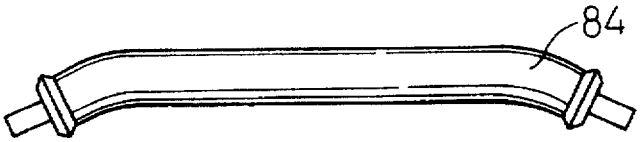
FIGS. 10A to 10E are views of auxiliary spreading means used together with the spreading roller of the present invention.
Figure 10B:
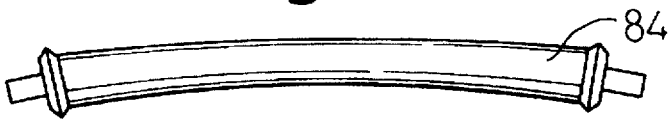
Figure 10C:
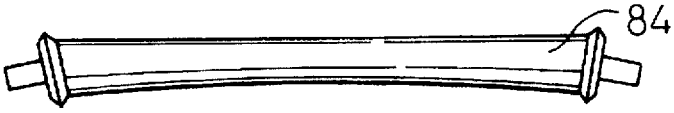
Figure 10D:
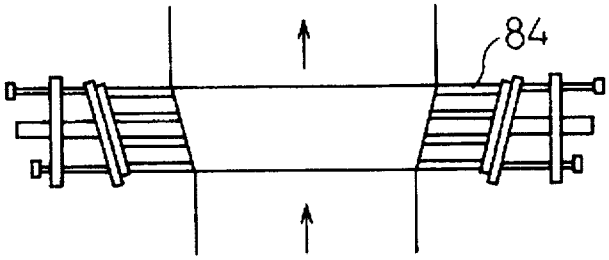
Figure 10E:
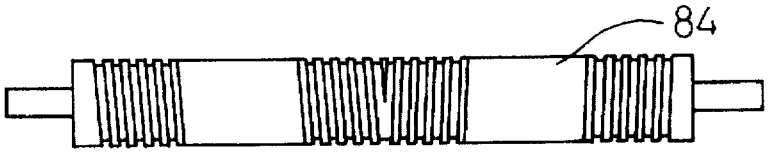

The auxiliary spreading roller 84 of FIG. 10D is an example of a flat expander. FIG. 10E shows an example of a screw roll, which has no curvature, compared with the spreading roller 34 and 36 according to the present invention.

Figure 11:
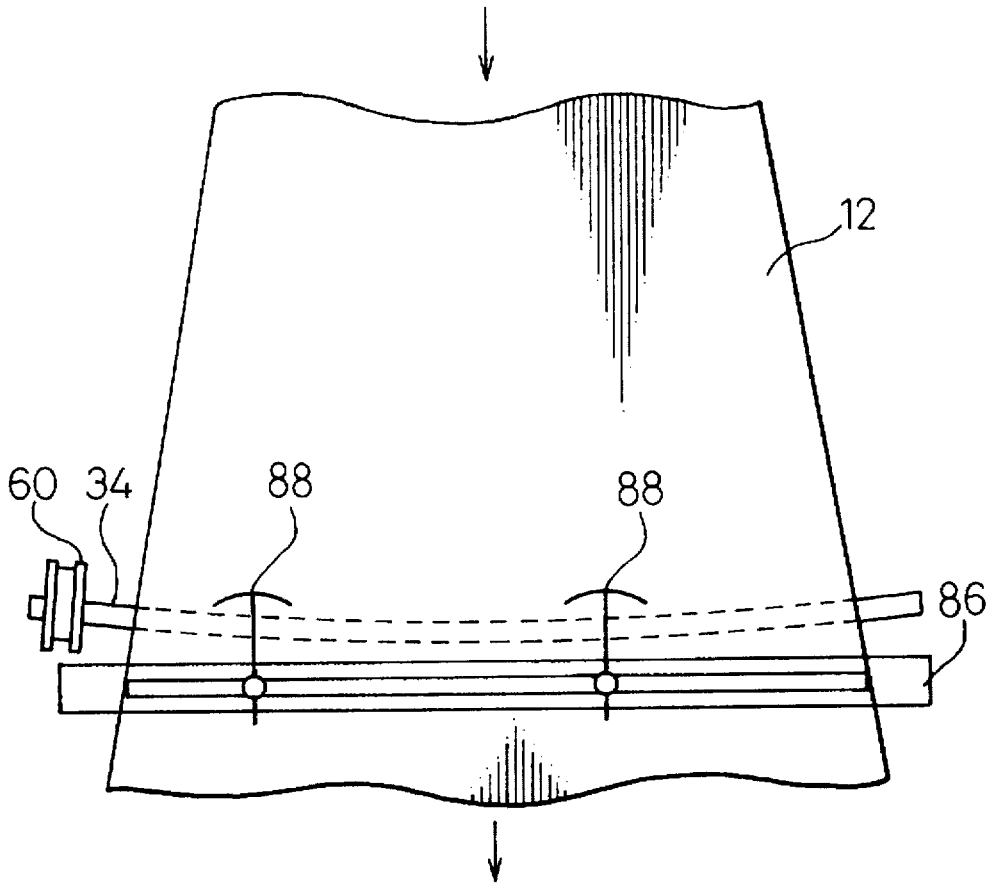
FIG. 11 is a view of a partial pressing member used together with the spreading roller.
Figure 12:
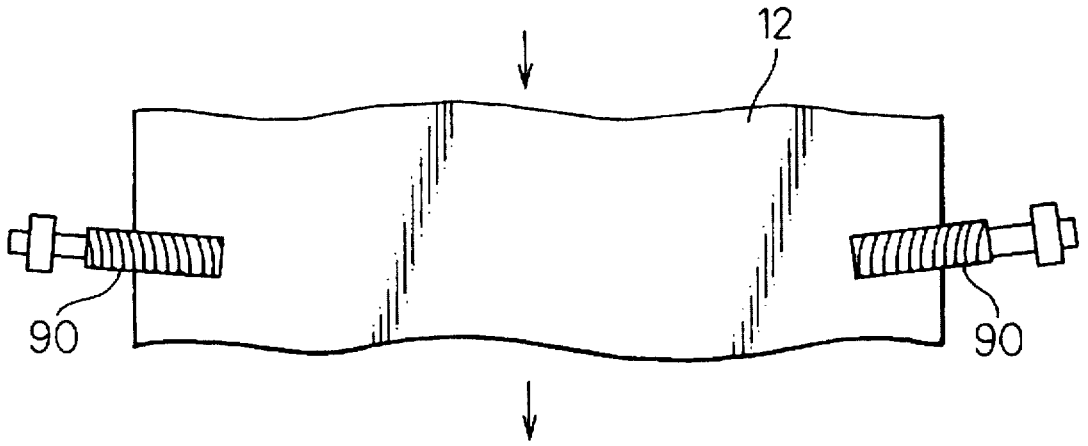
FIG. 12 is a view of a side edge spreading adjustment member used together with the spreading roller.

FIGS. 11 and 12 show examples of partial auxiliary spreading members which can be used with the spreading rollers 34 and 36. In FIG. 11, a long cross bar 86 is arranged in the vicinity of the spreading roller 34, and partially pressing members 88 are attached to the cross bar 86 in a position-adjustable manner. By applying the partially pressing member 88 onto a portion of the web 12 which is not sufficiently spread, a contact angle of the spreading roller with that portion of the web becomes larger to thereby increase the spreading ratio in that portion. Contrarily, if the partially pressing member is applied to the side of the web so that the web is away from the spreading roller, it is possible to reduce the spreading of the portion of the web at which the spreading ratio is too high.

In FIG. 12, a side edge spreading adjustment members 90 are arranged. The side edge spreading adjustment member 90 are rollers having spiral grooves or spiral projections and arranged oblique to the traveling web 12. The side edge spreading adjustment members 90 are most effective when they are disposed at a position on the downstream side of the spreading roller 36 and on the upstream side of the takeup roller 42, or on the upstream side of the heat treatment roller 44, similar to the side edge spreading roller 40 shown in FIGS. 1 and 2.

In the operation of the spreading apparatus 10 of the present invention, the web 12 is transversely spread by the spreading rollers 34 and 36. The width of the web 12 starts to increase at a spreading-starting point located on the upstream side of the spreading roller 34 and reaches the maximum value at the spreading roller 36. The spreading of the web 12 starts from the roller which rotates at the same speed as the traveling speed of the web 12. In the illustrated embodiment, the spreading-starting point is at the torque sensing roller 24 located on the upstream side of the speed regulating roller 22. In order to ensure stability of the spreading operation, it is preferable that the width and the position of the web 12 are constant on the speed regulating roller 22. Therefore, the speed of the speed regulating roller 22 is controlled. When the width Q of the web 12 detected by the width sensor 26 is smaller than a predetermined value decided depending on kinds and grades of the web 12, the speed of the speed regulating roller 22 is decreased by the motor M2. When the width Q is larger than the predetermined value, the speed of the speed regulating roller 22 is increased by the motor M2. The increase in the speed of the speed regulating roller 22 causes the width Q of the web 12 to decrease. Normally, the speed regulating roller 22 is driven at a slower speed than the traveling speed of the web 12, or in the extreme case, may be stationary.

The spreading rollers 34 and 36 comprising the curved rod-like member 50 having circumferentially extending projections, such as the grooves 52 and the projections 54 or the coil spring 64, or the coil springs 70*a* and 70*b*, is driven at a higher peripheral speed than the traveling speed of the web 12. That is, the outer tube 58 or the coil spring 64, or the coil springs 70*a* and 70*b* are driven for rotation. Accordingly, the web 12 is spread at a relatively large spreading ratio, such as at least 1.2 times, preferably 2 times or more. If the spreading rollers 34 and 36 are provided in a multi-stage manner, the spreading operation can be carried out more uniformly at a larger spreading ratio. According to the present invention, the uniformity in the spread web is further improved compared with the prior art spreading operation wherein an expander roll only is used, because the spreading operation can be carried under less stringent conditions and relatively low web tension wherein the curvature of the curved rod-like member 50 is reduced, the contact angle of the web 12 with the spreading roller 34 and 36 is smaller, the contact angle of the web 12 is smaller, and the entrance angle of the web 12 is larger than the exit angle thereof.

Figure 13:
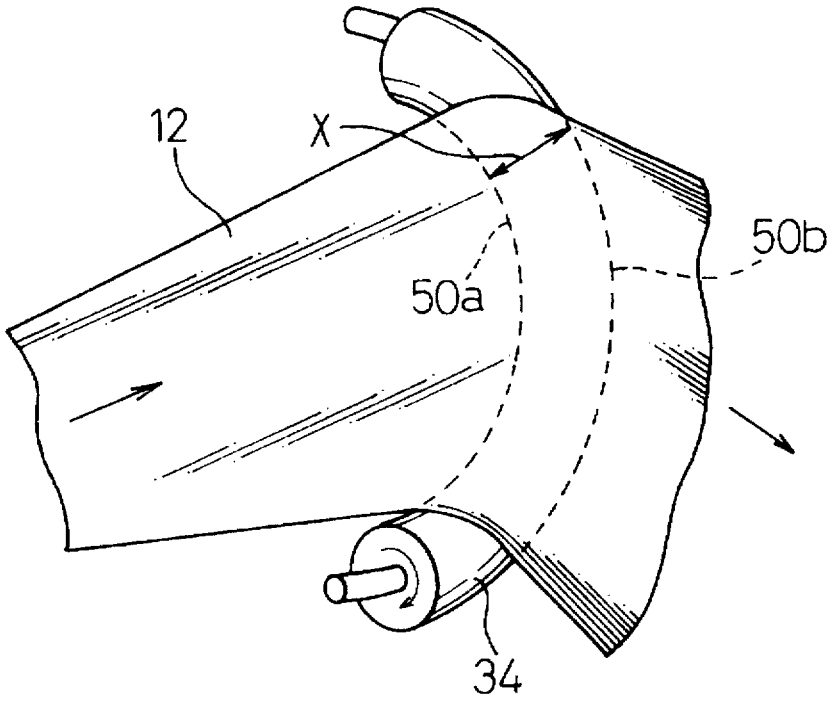
FIG. 13 is a perspective view illustrating the spreading roller and a traveling web.
Figure 14:
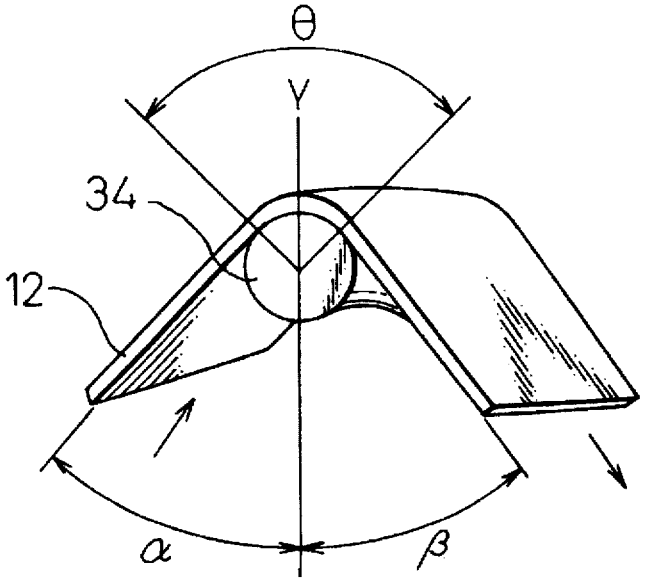
FIG. 14 is a view illustrating a contact angle of a web relative to the spreading roller of FIG. 13.

FIGS. 13 and 14 illustrate the principle of the spreading operation according to the present invention. FIG. 13 illustrates the state in which the traveling web 12 contacts the curved spreading roller 34. The grooves or the spring of the spreading roller 34 and the drive mechanism associated therewith is deleted for clarity. FIG. 14 is a cross-sectional perspective view taken along a cross-sectional plane passing through a center of the spreading roller 34 and the center of the web traveling path. In FIG. 14, Y axis is defined by a line intersecting an axis of the spreading roller 34 at the center thereof and extending from the center of the concave side 50*a* of the curved spreading roller 34 to the center of the convex side 50*b* thereof.

As shown in FIGS. 13 and 14, the web 12 passes the spreading roller 34 from the concave side 50*a* side to the convex side 50*b* side. The entrance angle of the web 12 to Y axis is represented by $\alpha$, and the exit angle is by $\beta$. The contact angle of the web 12 with the spreading roller 34 is represented by $\theta$. There is the following relationship between the contact angle $\theta$, the entrance angle $\alpha$ and the exit angle $\beta$:

$$\theta=180-(\alpha+\beta)$$

The web 12 is subjected to a spreading action to some extent due to the fact that the web 12 passes through the spreading roller 34 from the concave side 50*a* side to the convex side 50*b* side. The spreading action becomes more intense as the contact angle $\theta$ increases. Especially, if the entrance angle $\alpha$ and the exit angle $\beta$ are as close as possible to each other, the convex side 50*b* of the spreading roller 34 can be largely utilized to enhance the spreading action. In addition, the spreading action is more enhanced by the rotation of projections (projections such as grooves 52, projections 54 or spring 64) on the surface area of the spreading roller 34. That is, as shown in FIG. 13, the rotational direction, shown by the arrow X, of the projections on the surface area of the spreading roller 34 is deviated outward relative to the traveling direction of the web 12 so as to draw the web 12 outwards. Therefore, in comparison with the conventional spreading operation merely using the expander roll, it is possible to carry out the spreading operation at a higher spreading ratio according to the present invention. In the conventional spreading operation merely using the expander roll, it is necessary to select the contact angle $\theta$ in the range from 30 to 90 degrees, and the uniformity of the spread web may often be deteriorated if the contact angle is greater. According to the present invention, it is possible that the contact angle $\theta$ is 30° or less, in many cases, a favorable result is obtained with the contact angle of about 10 degrees. In addition, it is possible to improve the uniformity of the spread web, by selecting the entrance angle $\alpha$ larger than the exit angle $\beta$. In this way, according to the present invention, it is possible to increase the spreading ratio and improve the uniformity of the spread web.

The spreading operation using the spreading rollers 34 and 36 has a function for correcting unevenness, if unevenness occurs in a spread web. That is, if there is a portion at which the web is insufficiently spread, the spreading ratio in this portion can be increased by positively pressing that portion onto the spreading rollers 34 and 36. On the contrary, if there is a portion at which the web is excessively spread, the spreading ratio thereof can be reduced by releasing this portion from the spreading roller. For this purpose, the partially pressing members 88 shown in FIG. 11 are used.

In the spreading operation, in general, the opposite end portions of the web 12 are not fully spread, and even if the opposite end portions of the web 12 are spread, they tend to subsequently shrink, resulting in an insufficient spreading. Therefore, it is useful to forcibly spread the opposite end portions only to obtain uniform products. According to the present invention, as way of an example, the roller having the spiral grooves is obliquely urged onto the respective end portion of the web. The cloth guider 38 and the side edge spreading adjustment member 90 shown in FIGS. 1 and 12 can be used to this end.

It is important that the spreading apparatus 10 is driven so that a constant web tension is maintained, because the uneven spreading occurs otherwise. Therefore, it is important that the spreading apparatus is operated in combination with a tension control device. Thus, according to the present invention, it is possible to reduce the spreading tension, because the spreading rollers 34 and 36 have a large spreading capability. The small spreading tension does not cause the resultant product to be damaged, and leads to uniform spreading since the tension of the web in contact with the spreading roller becomes uniform even at a corner portion.

The distance from the spreading-starting point (corresponding to the torque sensing roller 24) to the second stage spreading roller 36, i.e., the spreading distance, is important for achieving the uniform spreading. If the spreading distance is too short, uniform spreading is cannot be expected because acute spreading is necessary. If there is a roller rotating at the same peripheral speed as the traveling speed of the web, the web is not subjected to the spreading operation and the width of the web is maintained unchanged until the web reaches that point. In general, the spreading-starting point corresponds to a position of the final roller rotating at the same speed as the web traveling speed. According to the study on the distance from the spreading-starting point to the spreading roller, i.e., the spreading distance, it has been found that the spreading distance must be at least 2 times or more of the width of the web after spreading.

According to the present invention, an automatic control is carried out to always obtain a constant quality in the resultant web, even though there are changing factors, such as kinds of web, spreading conditions such as a spreading ratio, or operational factors such as a line speed or a line tension. Not only a whole spreading ratio but also a partial spreading ratio, i.e., unevenness of a web density, can be controlled to ensure the quality of the products. This can be first established by forcibly driving the spreading roller, using the spreading rollers arranged at a multistage manner, and combining this with the tension control.

FIGS. 15A to 19B illustrate examples of webs 12 to be used and the resultant webs 12*a* after the spreading operation, respectively. The spreading apparatus 10 according to the present invention is applicable to a broad web 12 having an initial width of 300 mm or more and a resultant width of 1000 mm or more after spreading. However, in a filament tow, since the web 12 generally has an initial width of about 100 mm, and a resultant width of the spread web 12*a* is 200 mm or more. The spreading ratio in the present invention may be 2 or more when a split web or a slit web is used, and 1.2 or more when other kinds of nonwoven fabric are used.

Figure 15A:
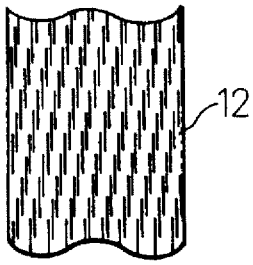
FIGS. 15A and 15B are views of an example of a split web before and after the spreading operation, respectively.
Figure 15B:
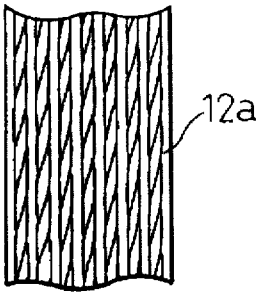

FIG. 15A illustrates a broad split web 12, and FIG. 15B illustrates a broad split web 12*a* obtained by spreading the broad split web 12 in FIG. 15A in the transverse direction at the spreading ratio of 3. Such broad split webs 12 and 12*a* are described, for example, in Japanese Examined Patent Publication (Kokoku) No. 46-39486 and Examined Utility Model Publication (U. M. Kokoku) No. 52-13371.

Figure 16A:
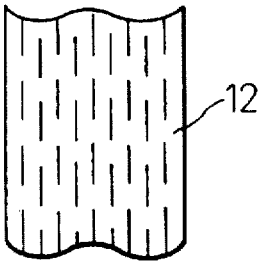
FIGS. 16A and 16B are views of an example of a slit web before and after the spreading operation, respectively.
Figure 16B:
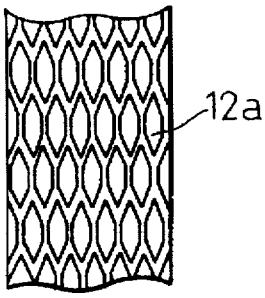

FIG. 16A illustrates a broad slit web 12, and FIG. 16B illustrates a broad slit web 12*a* obtained by spreading the broad slit web 12 in FIG. 16A in the transverse direction at the spreading ratio of 3. Such broad split webs 12 and 12*a* are described, for example, in Japanese Examined Patent Publication (Kokoku) No. 51-37390 and Examined Utility Model Publication (U. M. Kokoku) No. 54-30384.

Figure 17A:
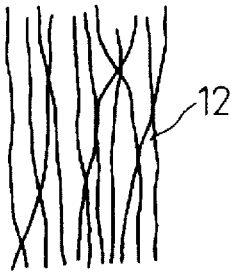
FIGS. 17A and 17B are views of an example of a filament tow before and after the spreading operation, respectively.
Figure 17B:
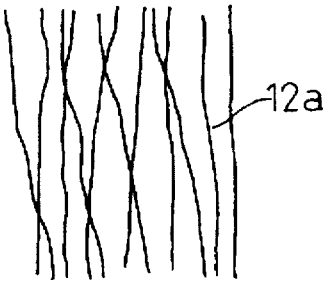

FIG. 17A illustrates a filament tow 12, and FIG. 17B illustrates a filament tow 12*a* obtained by spreading the filament tow 12 in FIG. 17A in the transverse direction at the spreading ratio of 3.

Figure 18A:
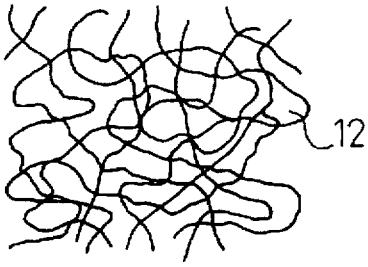
FIGS. 18A and 18B are views of an example of a spun-bonded nonwoven fabric before and after the spreading operation, respectively.
Figure 18B:
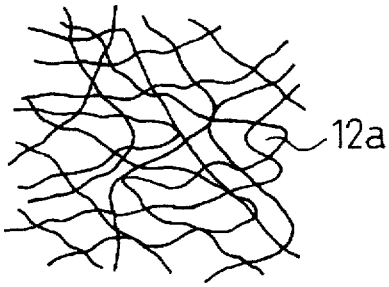

FIG. 18A illustrates a spun-bonded nonwoven fabric 12, and FIG. 18B illustrates a spun-bonded nonwoven fabric 12*a* obtained by spreading the spun-bonded nonwoven fabric 12 in FIG. 18A in the transverse direction at the spreading ratio of 1.5.

Figure 19A:
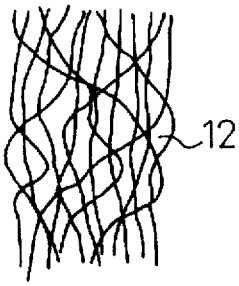
FIGS. 19A and 19B are views of an example of a longitudinally stretched nonwoven fabric before and after the spreading operation, respectively.
Figure 19B:
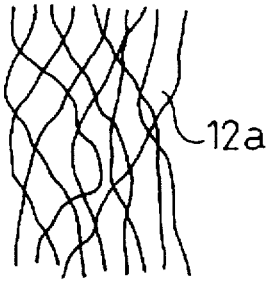

FIG. 19A illustrates a longitudinally stretched nonwoven fabric 12, and FIG. 19B illustrates a longitudinally stretched nonwoven fabric 12*a* obtained by spreading the longitudinally stretched nonwoven fabric 12 in FIG. 19A in the transverse direction at the spreading ratio of 1.5. The longitudinally stretched nonwoven fabric is described, for example, in Japanese Examined Patent Publication (Kokoku) No. 3-36948. Other nonwoven fabrics may be used, such as a melt-blown nonwoven fabric, needle-punched nonwoven fabric, water/needle-punched nonwoven fabric or dry type nonwoven fabric.

Since the broad split web 12, the broad slit web 12 and the filament tow 12 shown in FIGS. 15A, 16A and 17A, respectively, have less filament components extending in the transverse direction, they are particularly suitable for being spread by the spreading apparatus according to the present invention at a spreading ratio of 2 or more. If the web is in the range from 100,000 denier to 1,000,000 denier, the web tension is in the range from 2 kg to 50 kg, which corresponds to a stress in the range from 0.002 g/d to 0.05 g/d.

In the spun-bonded nonwoven fabrics 12 and the longitudinally stretched nonwoven fabric 12 shown in FIGS. 18A and 19A, respectively, filaments are largely entangled with each other, necessitating a larger tension for spreading the same, which in turn requires a larger contact angle. According to the present invention, it is possible to obtain a spreading ratio of 1.2 or more. Since a thickness of an individual filament in the longitudinally stretched nonwoven fabric 12 is one fifth to one tenth of that in the spun-bonded nonwoven fabric 12, the former fabric has a larger number of filaments than the latter if both have the same basis weight.

When a plurality of spreading rollers 34 and 36 are used, it is advantageous that the contact angle and the tension of the web per spreading roller are selected within less stringent condition and the spreading operation is carried out by the plurality of spreading rollers as a whole, in order to obtain a spread web with high quality. When a web formed of fibers firmly entangled with each other such as a nonwoven fabric is processed, it is favorable to arrange a plurality of spreading rollers 34 and 36 close to front and rear surfaces of the web so that the spreading capability is enhanced.

Figure 20:
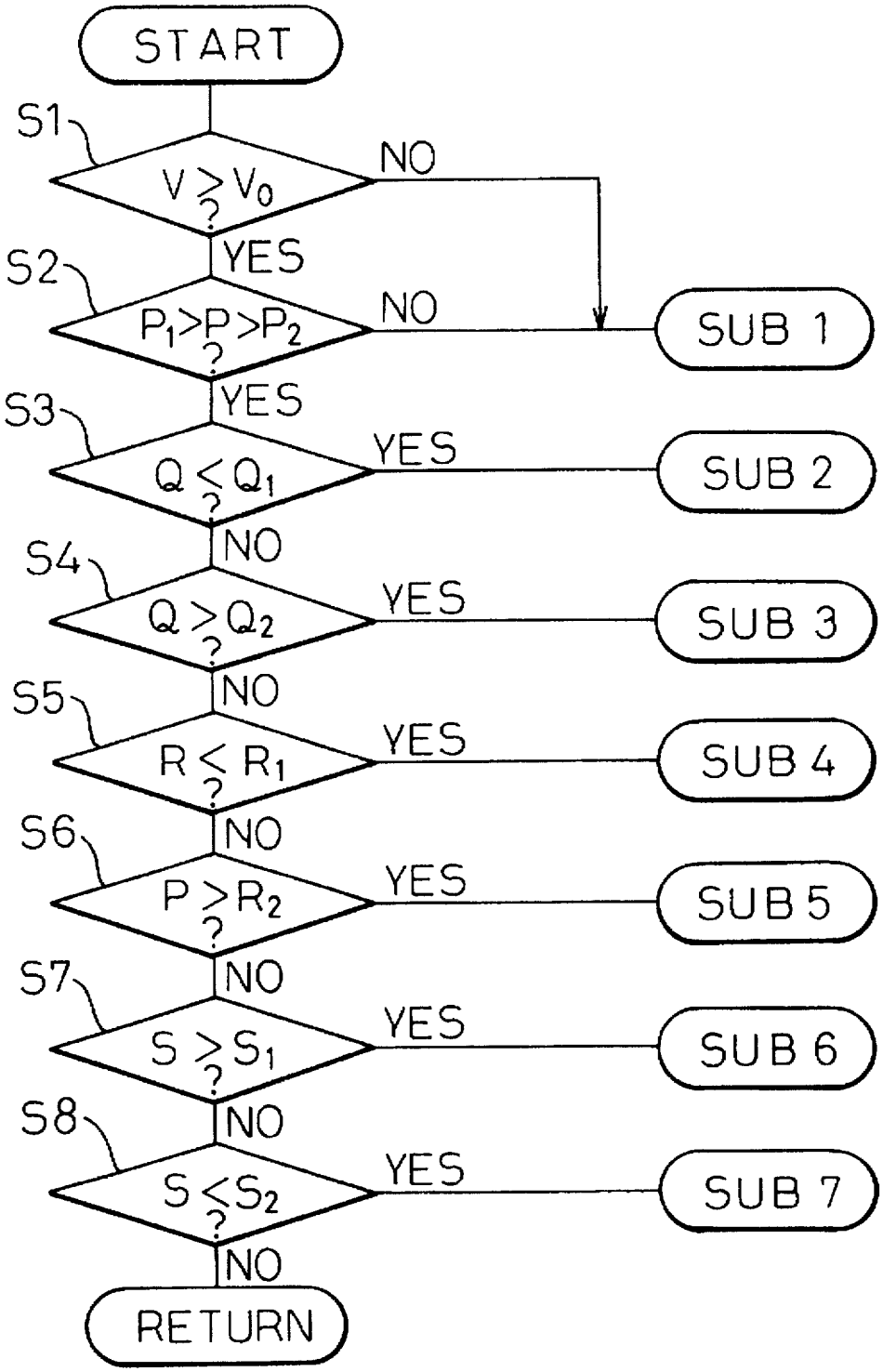
FIG. 20 is a flow chart for the control operation of the web spreading apparatus of FIGS. 1 and 12.

FIG. 20 illustrates a flow chart for automatically controlling the spreading operation of the web 12, which is carried out by the spreading apparatus 10 shown in FIGS. 1 and 2.

The first spreading roller 34 is formed of an expander roll having a relatively small curvature such as that shown in FIG. 10B, on which grooves are cut, so that a central portion of the web 12 is readily spread, and the second spreading roller 36 is formed of an expander roll having a relatively large curvature such as that shown in FIG. 10A, on which grooves are cut, so that end portions of the web 12 are readily spread.

Figure 21:
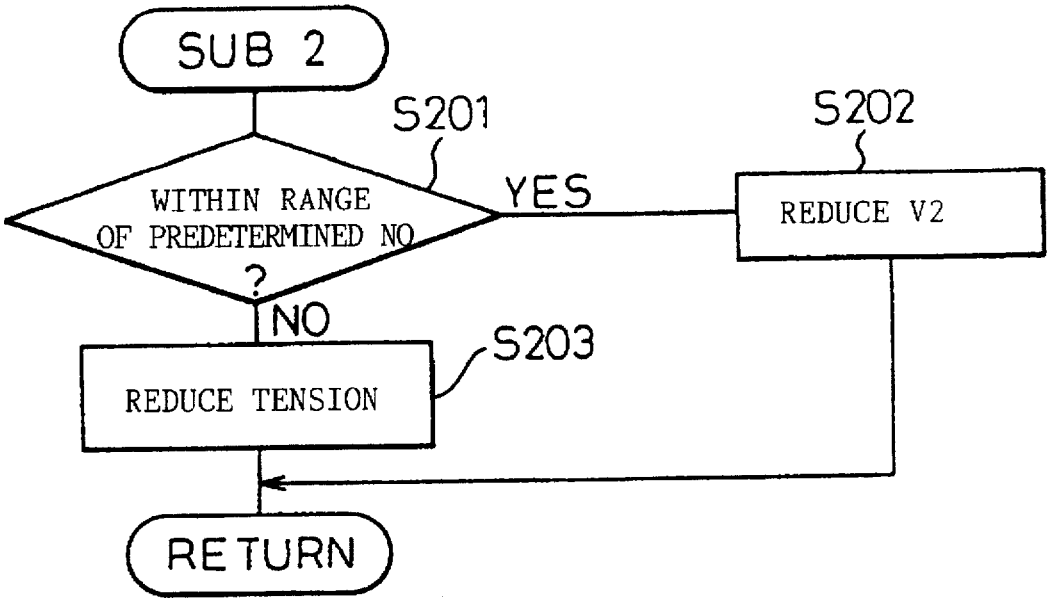
FIG. 21 is a view illustrating the subroutine 2 of the flow chart in FIG. 20.

At step S1, it is determined whether or not the traveling speed V of the web 12 is larger than a predetermined value $V_0$. If the result is NO; the routine proceeds to subroutine 1, while if the result is YES, the routine proceeds to step S2. At step 2, it is determined whether or not a tension P of the web 12 is within a predetermined range ($P_1>P>P_2$). If the result is NO the routine proceeds to subroutine 1, while if the result is YES, the routine proceeds to step S3. In subroutine 1, if the traveling speed V of the web 12 is smaller than the predetermined value $V_0$ or the tension P is lower than $P_2$, one web 12 is connected to the next web 12 or another operation is carried out. At step S3, it is determined whether or not a width Q of the web 12 detected by the width sensor 26 is smaller than a predetermined minimum value $Q_1$. If the result is YES, the routine proceeds to subroutine 2, while if the result is NO, the routine proceeds to step S4. In subroutine 2, as shown in FIG. 21, it is determined at step S201 whether or not the number of judgements in which the width Q of the web 12 is larger than the predetermined minimum value $Q_1$ is less than a predetermined value. If the result is YES (i.e., the number is less than the predetermined value), the routine proceeds to step 202, at which a speed (V2) of the speed regulating roller 22 is reduced. If the result at step S201 is NO (i.e., the number is more than the predetermined value), it is determined that it is impossible to regulate the width of web 12 at a constant value solely by controlling the speed of the speed regulating roller 22, and instead, a reference value of the tension itself is reset to a lower level.

Figure 22:
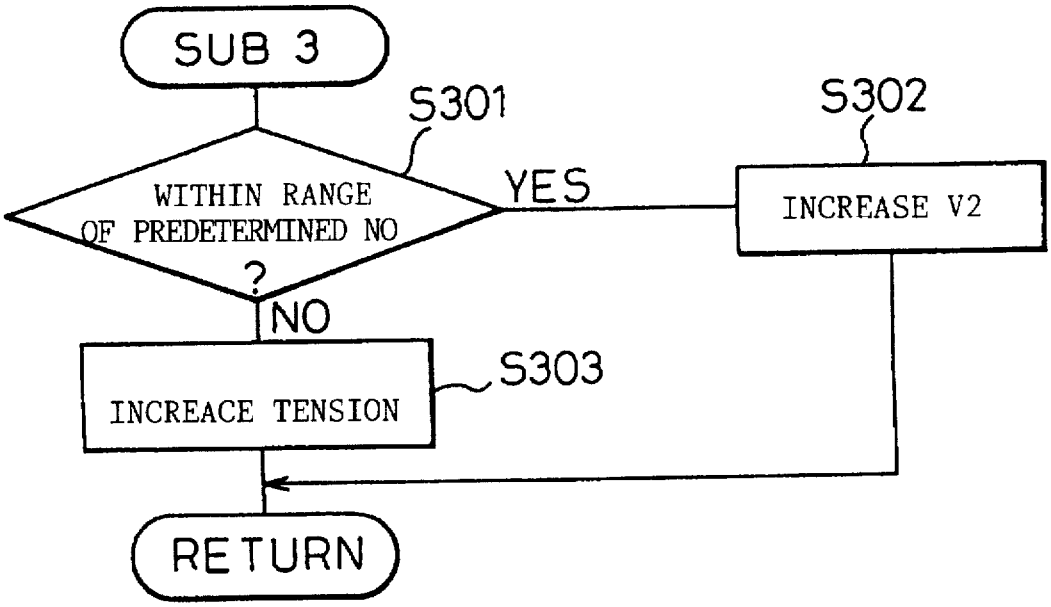
FIG. 22 is a view illustrating the subroutine 3 of the flow chart in FIG. 20.

In FIG. 20, at step S4, it is determined whether or not the width Q of the web 12 is larger than a predetermined maximum value $Q_2$. If the result is YES, the routine proceeds to subroutine 3, while if the result is NO, the routine proceeds to step S5. In subroutine 3, as shown in FIG. 22, it is determined at step S301 whether or not the number of the judgements in which the width Q of the web 12 is larger than the predetermined maximum value $Q_2$ is larger than a predetermined value. If the result is YES (i.e., the number is less than the predetermined value), the routine proceeds to step 302, at which the speed $V_2$ of the speed regulating roller 22 is increased. If the result is NO (i.e., the number is more than the predetermined value), it is determined that it is impossible to regulate the width of web 12 at a constant value solely by controlling the speed of the speed regulating roller 22, and instead, the tension reference value is reset to a higher level.

Figure 23:
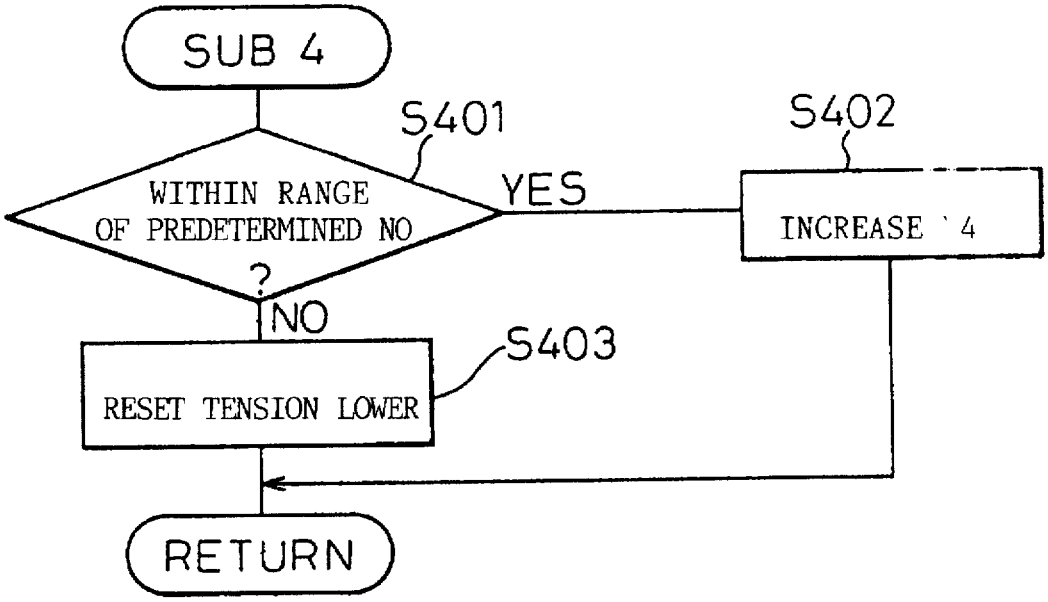
FIG. 23 is a view illustrating the subroutine 4 of the flow chart in FIG. 20.

At step S5, it is determined whether or not a width R of the web 12 detected by the spreading state sensor 48 is smaller than a predetermined minimum value $R_1$. If the result is YES, the routine proceeds to subroutine 4, while if the result is NO, the routine proceeds to step S6. In subroutine 4, as shown in FIG. 23, it is determined at step S401 whether or not the number of the judgements in which the width R of the spread web **12*a* is smaller than the minimum value $R_1$ is larger than a predetermined reference number. If the result is YES (i.e., the number is less than the predetermined value), the routine proceeds to step S402, at which a speed V4 of the second spreading roller 36 is increased. If the result at step S401 is NO (i.e., the number is more than the predetermined value), the routine proceeds to step S403**, at which the tension reference value is reset to a higher level.

Figure 24:
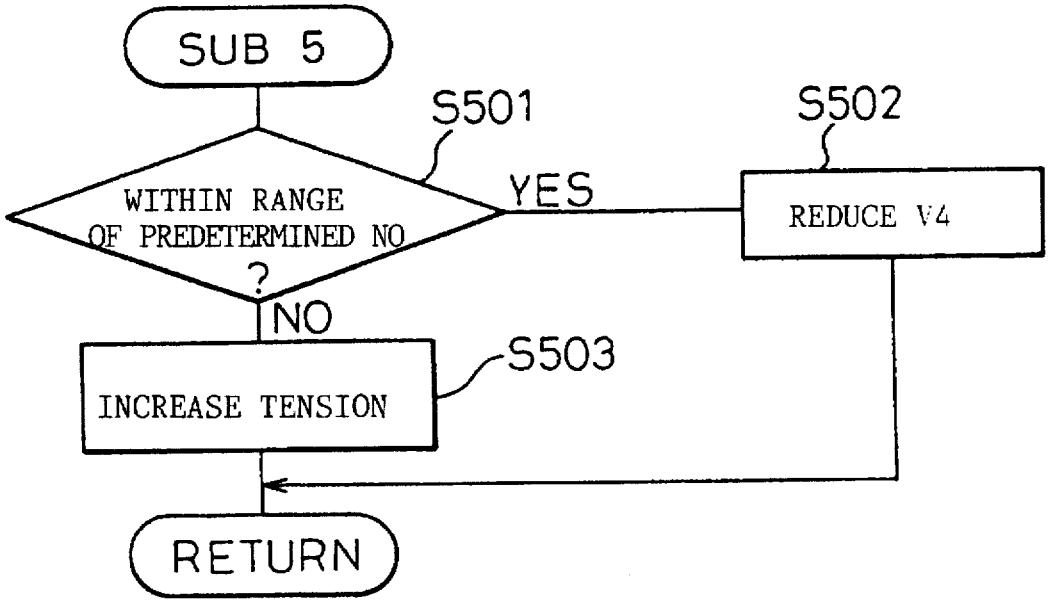
FIG. 24 is a view illustrating the subroutine 5 of the flow chart in FIG. 20.

At step S6, it is determined whether or not the width R of the web 12 detected by the spreading state sensor 48 is larger than a predetermined maximum value $R_2$. If the result is YES, the routine proceeds to subroutine 5, while the result is NO, the routine proceeds to step S7. In subroutine 5, as shown in FIG. 24, it is determined at step S501 whether or not the number of the judgements in which the width R of the widened web **12*a* is larger than the maximum value $R_2$ is larger than a predetermined reference number. If the result is YES (i.e., the number is less than the predetermined value), the routine proceeds to step S502, at which the speed V4 of the second spreading roller 36 is reduced. If the result at step S501 is NO (i.e., the number is more than the predetermined value), the routine proceeds to step S503**, at which the tension reference value is reset at a higher level.

Figure 25:
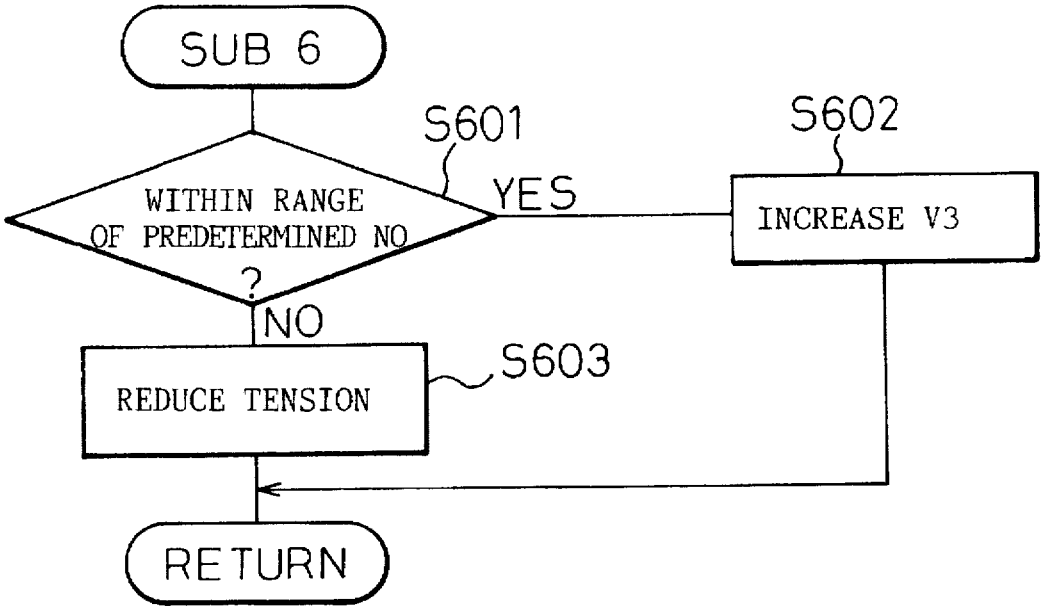
FIG. 25 is a view illustrating the subroutine 6 of the flow chart in FIG. 20.

At step S7, it is determined whether or not a density S of the web 12 detected by the spreading state sensor 48 is larger than a predetermined maximum value $S_1$. If the result is YES, the routine proceeds to subroutine 6, while if the result is NO, the routine proceeds to step S8. The density S of the web 12 is detected by detecting the thickness of the web 12 at the transverse center thereof. In subroutine 6, as shown in FIG. 25, it is determined at step S601 whether or not the number of the judgements in which the density S of the widened web **12*a* is larger than the maximum value $S_1$ is larger than a predetermined reference number. If the result is YES (i.e., the number is less than the predetermined value), the routine proceeds to step S602, at which the speed $V_3$ of the first spreading roller 34 is accelerated. If the result at step S601 is NO (i.e., the number is more than the predetermined value), the routine proceeds to step S603**, at which the tension reference value is reset at a lower level.

Figure 26:
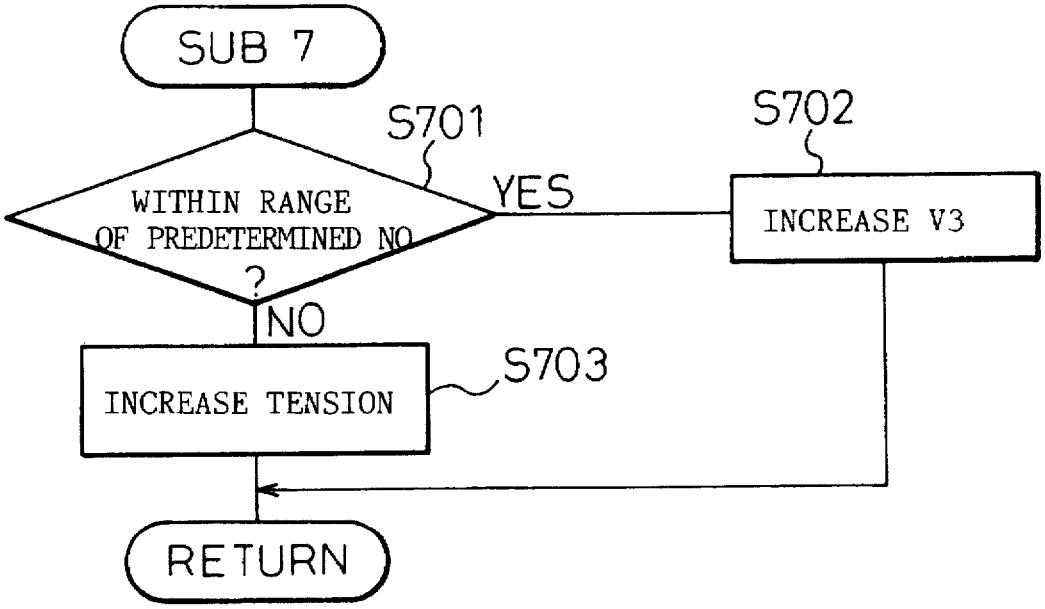
FIG. 26 is a view illustrating subroutine 7 of the flow chart in FIG. 20.

At step S8, it is determined whether or not a density S of the web 12 detected by the spreading state sensor 48 is smaller than a predetermined minimum value $S_2$. If the result is YES, the routine proceeds to subroutine 7, while if the result is NO, the routine returns to "RETURN". In subroutine 7, as shown in FIG. 26, it is determined at step S701 whether or not the number of the judgements in which the density S of the widened web **12*a* is smaller than the minimum value $S_2$ is larger than a predetermined reference number. If the result is YES (i.e., the number is less than the predetermined value), the routine proceeds to step S702, at which the speed $V_3$ of the second spreading roller 36 is decelerated. If the result at step S701 is NO (i.e., the number is more than the predetermined value), the routine proceeds to step S703**, at which the tension reference value is reset at a lower level.

In this manner, the width of the web 12 is adjustable by automatically controlling the speeds of the respective rollers and the web tension at optimal values based on the detected tension, the width and the density of the web. The control is not limited to the flow chart shown in FIGS. 20 to 27, but may be carried out in various ways depending on kinds of webs 12, spreading ratios, or types and number of spreading rollers 34, 36 used. Also, if the spreading rollers 34 and 36 have two groups of projections arranged in symmetry with each other, each group may be driven independently from the other to have different speeds. In such a case, the speeds of the respective groups are suitably regulated by measuring speeds and densities in the opposite end portions of the web 12.

In the above-mentioned control, factors to be regulated for obtaining a suitable width of the web 12 are the speeds of the spreading rollers 34, 36 and the web tension. However, other factors may be used for the same purpose. For example, the contact angle of the web 12 with the spreading rollers 34 and 36, or the curvature of the spreading roller 34, 36 may be adjusted. The adjustment of the contact angle is carried out by providing a turn bar above the spreading rollers 34 and 36 and regulating the position thereof. Also, the degree of curvature may be changed by constructing the spreading rollers 34 and 36 from expander rolls of the type in which their curvatures may be adjusted by hydraulic pressure.

As described hereinabove, according to the present invention, a high quality spreading of the web can be carried out by a relatively simple structure. Further, according to the present invention, it is possible to obtain the spread web with high quality by carrying out the spreading operation under automatic control. Although the structure of the present invention is simple, the inventive apparatus is capable of spreading a broad web at a high speed, for example, of 100 m/min or more, even in a range from 200 m/min to 300 m/min, to result in a product having a width of 2 m or more, even in a range from 4 to 5 m. Also, since the spreading tension can be a low level, the present invention is applicable to webs which are liable to be fluffy.

We claim:

1. A web spreading apparatus for transversely spreading a web so that the width of the web after spreading is equal to or greater than 1.2 times the width of a web before spreading, said apparatus comprising:

conveying means for conveying the web along a predetermined conveying path;

tension control means for controlling tension of the travelling web;

spreading means arranged in the conveying path for transversely spreading the web;

said spreading means comprising a curved rod-like member having a concave side, a convex side and an outer circumference surface, and projections arranged generally circumferentially about an axis of the curved rod-like member;

said curved rod-like member being arranged so that the concave side is directed forward and the convex side is directed rearward, in the web travelling direction;

at least said projections being rotatable about the axis of the curved rod-like member at a speed higher than a travelling speed of the web; and said spreading means being arranged such that a spreading distance from a spreading-starting point to said spreading means is equal to or more than two times of the width of the web after spreading.

2. A web spreading apparatus as defined by claim 1, wherein the projections are arranged obliquely to the travelling direction of the web.

3. A web spreading apparatus as defined by claim 1, wherein the curved rod-like member comprises a curved shaft and an outer tube arranged about the curved shaft and rotatable relative to the curved shaft, said projections being arranged on the outer tube, said outer tube being driven for rotation.

4. A web spreading apparatus as defined by claim 3, wherein the outer tube has grooves on the outer circumference surface thereof, and the projections are formed between adjacent grooves.

5. A web spreading apparatus as defined by claim 4, wherein the projections extend in a spiral manner.

6. A web spreading apparatus as defined by claim 4, wherein the projections are symmetrically arranged in a spiral manner with respect to a center of the curved rod-like member.

7. A web spreading apparatus as defined by claim 4, wherein the projections are annular.

8. A web spreading apparatus as defined by claim 1, wherein the projections comprise at least one spring arranged about the curved rod-like member.

9. A web spreading apparatus as defined by claim 8, wherein the at least one spring is rotatable relative to the curved rod-like member.

10. A web spreading apparatus as defined by claim 8, wherein the at least one spring comprises symmetrically arranged members with respect to a center of the curved rod-like member, said members being rotatable at different speeds from each other.

11. A web spreading apparatus as defined by claim 1, further comprising a heating means arranged on the upstream side of the spreading means for releasing a strain in the travelling web.

12. A web spreading apparatus as defined by claim 1, further comprising a speed regulating roller on the upstream side of the spreading means.

13. A web spreading apparatus as defined by claim 1, further comprising a tension control roller disposed upstream of the speed regulating roller, said tension control roller defining the spreading-starting point.

14. A web spreading apparatus as defined by claim 1, further comprising a sensor means for detecting a width and a density of the spread on the downstream side of the spreading means, whereby at least one of a width of the web after spreading, a spreading ratio, and a spreading uniformity can be automatically controlled, by controlling a rotational speed of the spreading means and a tension of the travelling web based on an output from the sensor means.

15. A web spreading apparatus as defined by claim 1, wherein the web is one selected from the group consisting of a split web formed of a longitudinally uniaxially stretched film, a slit web formed of a longitudinally uniaxially stretched film, a filament tow, a nonwoven fabric and a longitudinally stretched web of a nonwoven fabric.

16. A web spreading apparatus as defined by claim 15, wherein the web is one selected from a group consisting of a split web formed of a longitudinally uniaxially stretched film, a slit web formed of a longitudinally uniaxially stretched film and a filament tow, and the spreading ratio is 2 or more.

* * * * *